US008657284B2

(12) United States Patent
Mizuno

(10) Patent No.: US 8,657,284 B2
(45) Date of Patent: Feb. 25, 2014

(54) SHEET CONVEYER

(75) Inventor: Masatsugu Mizuno, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/613,028

(22) Filed: Sep. 13, 2012

(65) Prior Publication Data

US 2013/0106053 A1 May 2, 2013

(30) Foreign Application Priority Data

Oct. 31, 2011 (JP) ..... 2011-238295

(51) Int. Cl.
*B65H 5/00* (2006.01)

(52) U.S. Cl.
USPC ..... 271/264; 347/222

(58) Field of Classification Search
USPC ..... 271/264; 347/222
See application file for complete search history.

(56) References Cited

U.S. PATENT DOCUMENTS

| | | | | |
|---|---|---|---|---|
| 4,489,651 | A * | 12/1984 | De Luca et al. | 101/93.36 |
| 4,660,053 | A * | 4/1987 | Tsutsumi et al. | 347/215 |
| 4,757,329 | A * | 7/1988 | Sato et al. | 347/218 |
| 4,910,602 | A * | 3/1990 | Sakuragi | 358/296 |
| 5,311,330 | A * | 5/1994 | Yeh | 358/498 |
| 6,219,077 | B1 * | 4/2001 | Suzuki | 347/171 |
| 6,426,803 | B1 | 7/2002 | Sasai et al. | |
| 6,529,227 | B1 | 3/2003 | Fukumura | |
| 6,651,975 | B2 * | 11/2003 | Ohtsuka et al. | 271/145 |
| 7,529,501 | B2 * | 5/2009 | Ishii | 399/107 |
| 2010/0244357 | A1 * | 9/2010 | Takahata | 271/4.08 |
| 2013/0057932 | A1 * | 3/2013 | Mukai | 358/498 |

FOREIGN PATENT DOCUMENTS

| | | | |
|---|---|---|---|
| JP | 64-010771 | B | 1/1989 |
| JP | 05-043656 | A | 6/1993 |
| JP | 05-046162 | A | 6/1993 |
| JP | 06-311276 | A | 11/1994 |
| JP | 10-327278 | A | 12/1998 |
| JP | 2000-238928 | A | 9/2000 |
| JP | 2013-058852 | A | 3/2013 |

* cited by examiner

*Primary Examiner* — Prasad Gokhale
(74) *Attorney, Agent, or Firm* — Banner & Witcoff, Ltd.

(57) ABSTRACT

A sheet conveyer, including a body, a processing unit, a conveyer roller, a control board, and a board cover, is provided. The body includes a conveyer path and a lower chute with an opening. The conveyer path and a lower area lower than the lower chute are connected with each other through the opening. The processing unit executes a process with the sheet being conveyed. The conveyer roller is partially exposed from the conveyer plane to the conveyer path through the opening. The control board is arranged in the lower area and controls the processing unit to execute the process. The board cover is arranged in a position between the conveyer plane and the control board and covers at least an upper part of the control board.

16 Claims, 10 Drawing Sheets

SHEET CONVEYER

CROSS REFERENCE TO RELATED APPLICATION

This application claims priority from Japanese Patent Application No. 2011-238295, filed on Oct. 31, 2011, the entire subject matter of which is incorporated herein by reference.

BACKGROUND

1. Technical Field

An aspect of the disclosure relates to sheet conveyer devices.

2. Related Art

A sheet conveyer device may include, for example, a main frame, and a part of an upper surface of the main frame may serve as a bottom plane of a conveyer path, along which a sheet is conveyed.

Further, the main frame may be formed to have openings, through which the conveyer path and space below the bottom plane are in communication with each other, and conveyer rollers, which are partially exposed to the conveyer path through the openings. In a position below the bottom plane and the conveyer rollers, a substrate may be arranged. The substrate may include an attachment frame, a light source, and an image sensor, which are fixed to the attachment frame.

With the configuration, the sheet conveyer device can convey the sheet along the conveyer path by the conveyer rollers and reads an image appearing on the sheet being conveyed by the image sensor.

SUMMARY

Over the sheet conveyer device configured as above, if water is spilled, the water may spread along the bottom plane of the conveyer path and enter the lower space below the bottom plane through clearances between edges of the openings and the conveyer rollers. Further, the water may reach the substrate. In such a case, the substrate may become wet and may be damaged by the water.

An aspect of the present disclosure may be advantageous in that sheet conveyer devices, which can prevent the substrate from being damaged by water, are provided.

According to an aspect of the disclosure, a sheet conveyer may be provided. The sheet conveyer may include a body, in which a conveyer path may be formed, wherein a sheet may be conveyed along the conveyer path, and a lower chute including a conveyer plane configured to support a lower side of the sheet being conveyed from below, wherein an opening may be formed in the conveyer plane, wherein through the opening the conveyer path and a lower area with respect to the lower chute may be connected with each other; a processing unit arranged in the body and configured to execute a process with the sheet being conveyed in the conveyer path; conveyer roller partially exposed from the conveyer plane to the conveyer path through the opening and configured to convey the sheet in a conveying direction; a control board arranged inside the body in the lower area with respect to the conveyer plane and configured to control the processing unit to execute the process; and a board cover arranged inside the body in a position between the conveyer plane and the control board and configured to cover at least an upper part of the control board.

BRIEF DESCRIPTION OF THE ACCOMPANYING DRAWINGS

Figure 7:
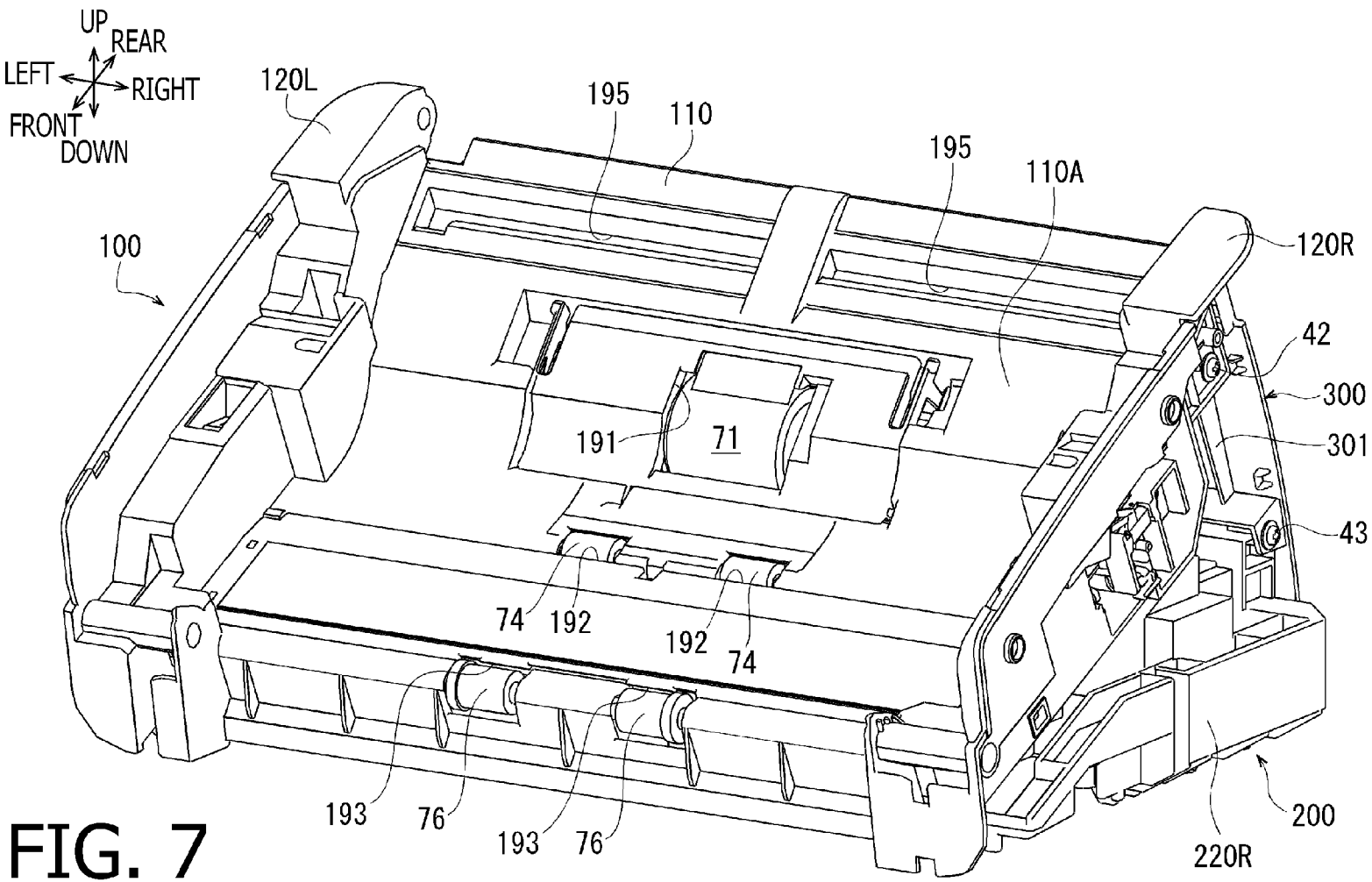

FIG. 7 is a perspective lookdown view of a part of a framework, including a lower chute 100, a board cover 200, and a rear cover 300, in the image reading apparatus 1 according to the embodiment of the disclosure.

Figure 8:
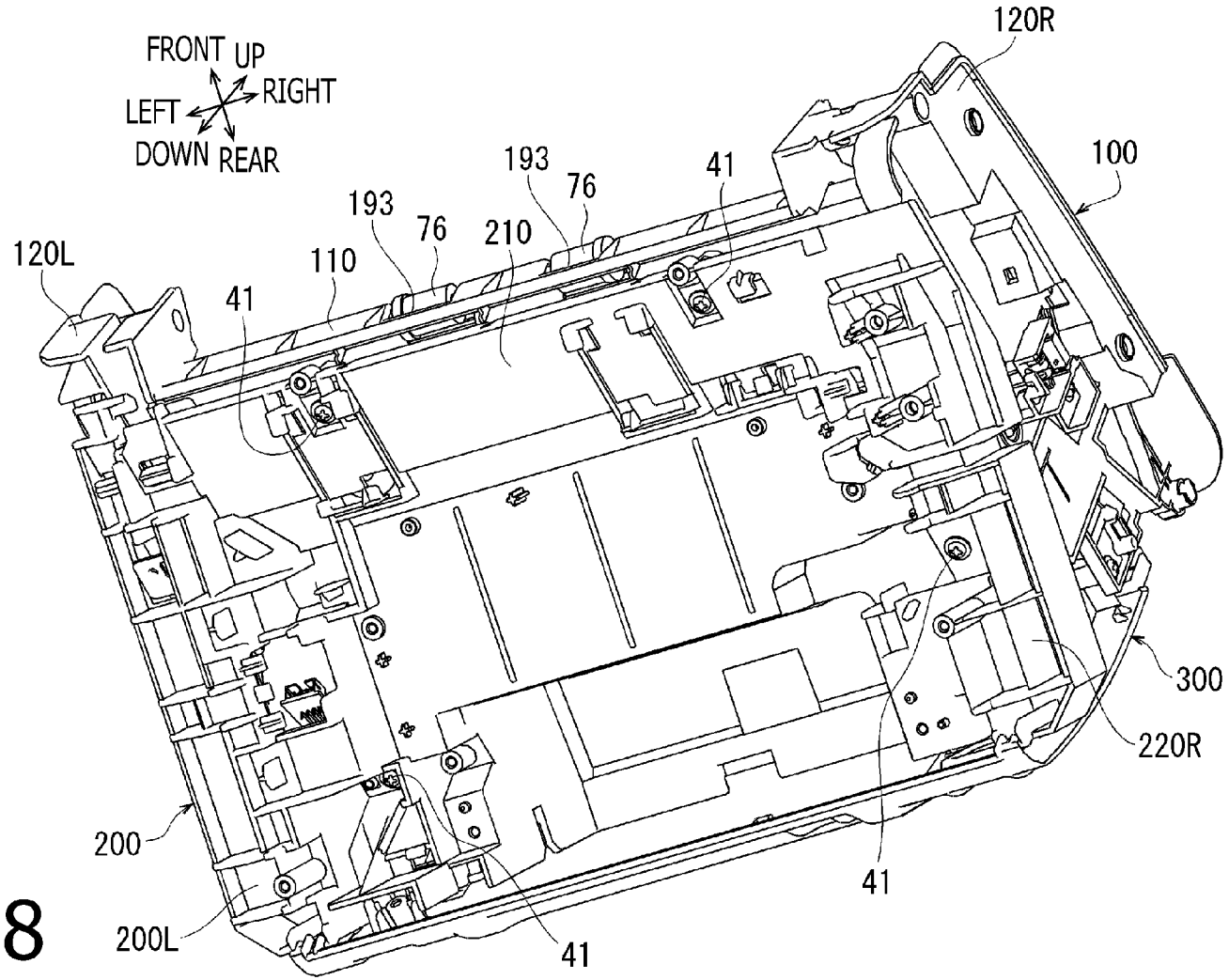

FIG. 8 is a perspective lookup view of a part of the internal framework, including the lower chute 100, the board cover 200, and the rear cover 300, in the image reading apparatus 1 according to the embodiment of the disclosure.

Figure 9:
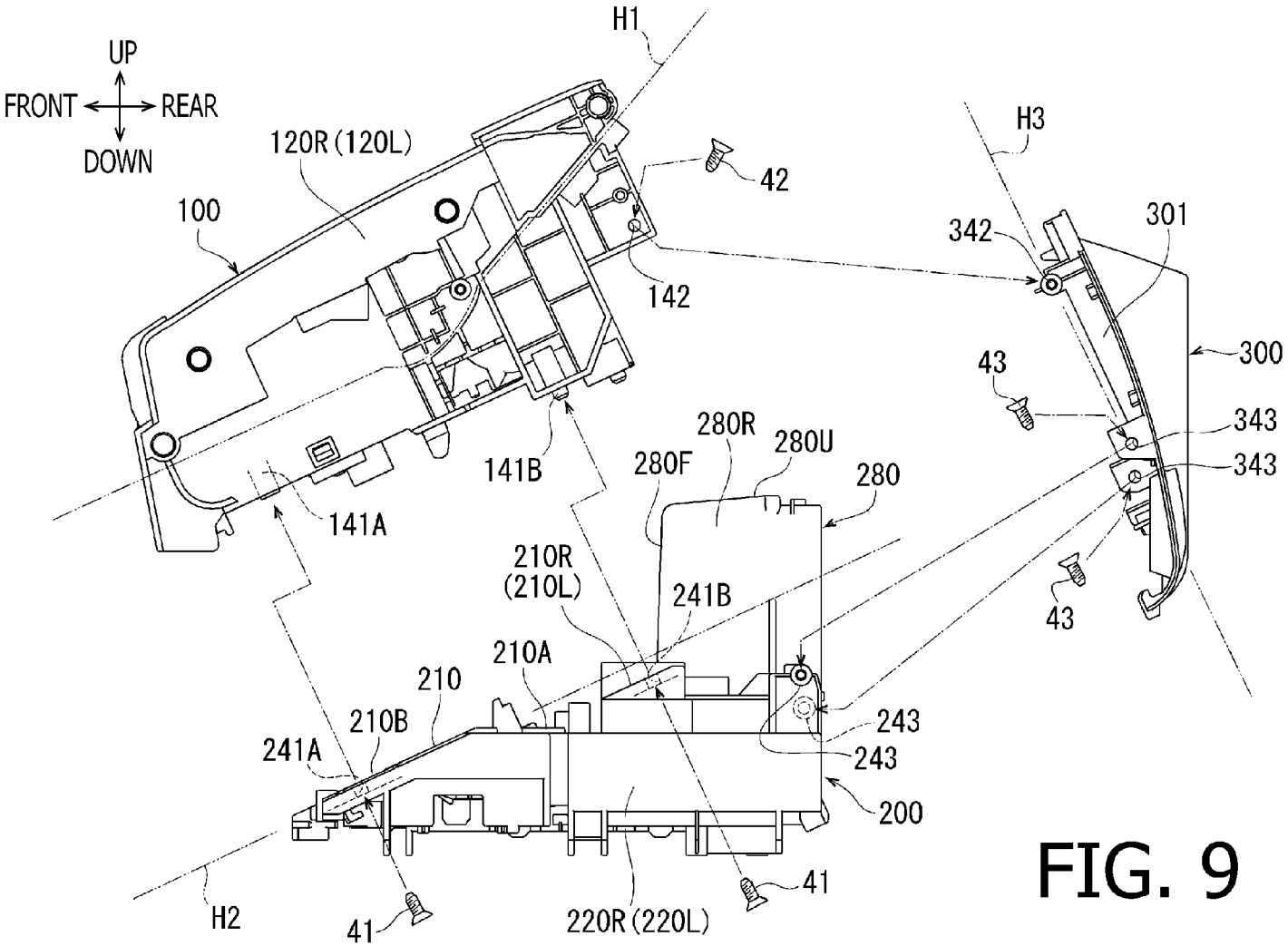

FIG. 9 is an exploded side view of the lower chute 100, the board cover 200, and the rear cover 300 in the image reading apparatus 1 according to the embodiment of the disclosure.

Figure 10:
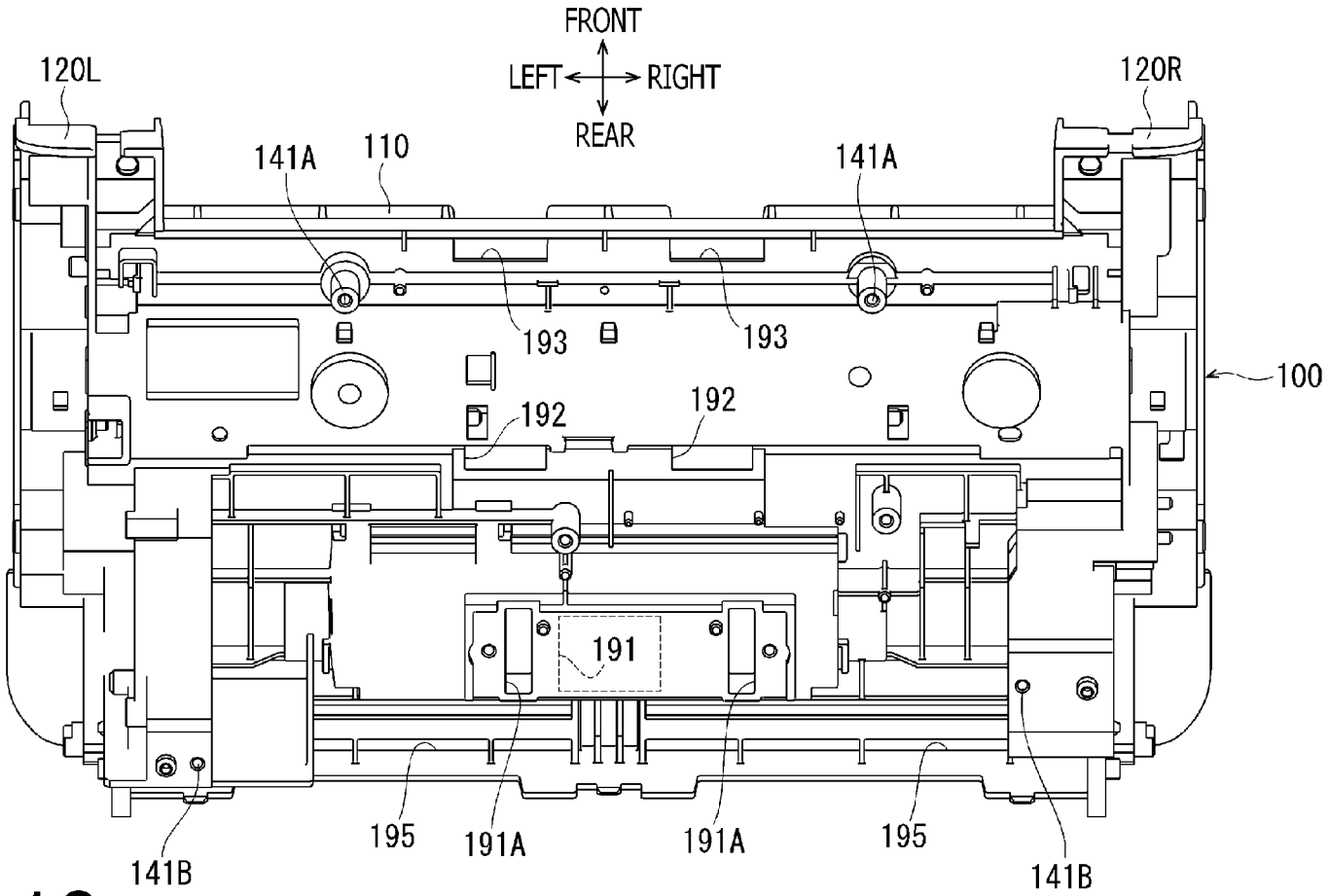

FIG. 10 is a bottom plane view of the lower chute 100 in the image reading apparatus 1 according to the embodiment of the disclosure.

Figure 11:
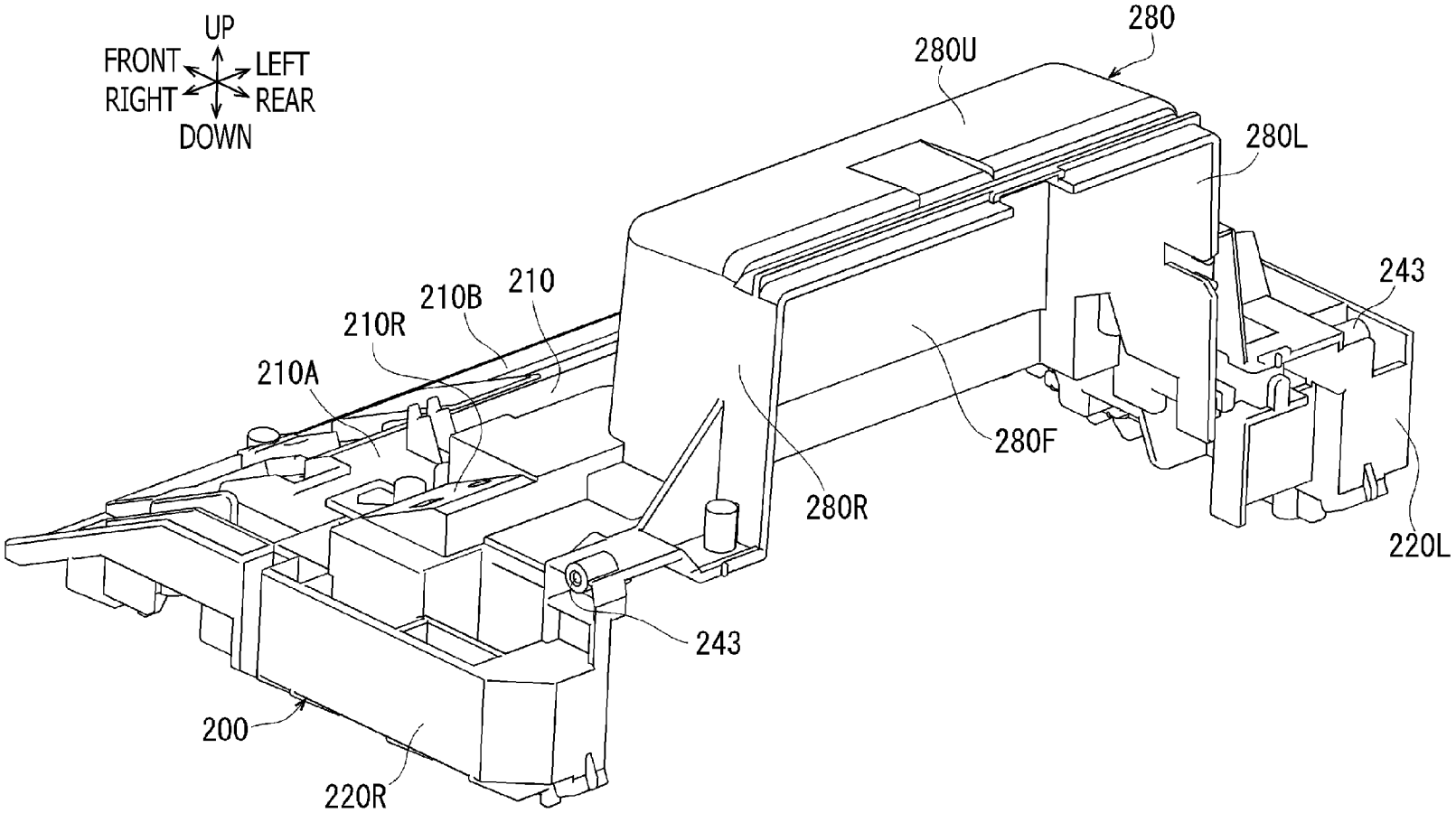

FIG. 11 a perspective view of the board cover 200 of the image reading apparatus 1 according to the embodiment of the disclosure.

Figure 12:
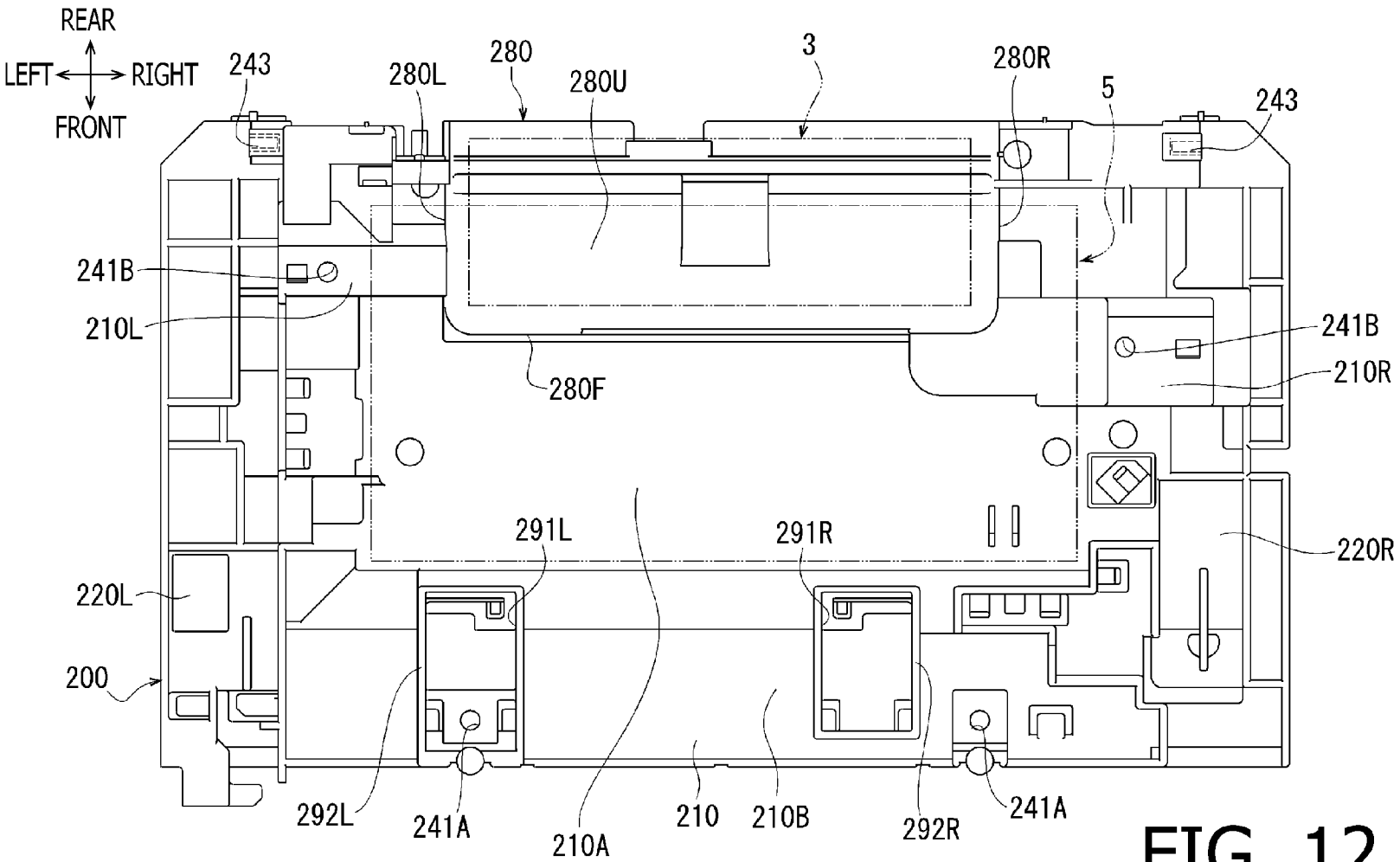

FIG. 12 is a top plane view of the board cover 200 of the image reading apparatus 1 according to the embodiment of the disclosure.

DETAILED DESCRIPTION

Hereinafter, an image reading apparatus 1 as an embodiment of a sheet conveyer device according to the disclosure will be described with reference to the accompanying drawings.

In the embodiment described below, directions concerning the image reading apparatus 1 will be referred to based on the orientation indicated by arrows shown in each drawing. For example, a viewer's lower-left side appearing in FIG. 1, on which a discharge tray 6 is arranged, is referred to as a front face of the image reading apparatus 1. An upper-right side in FIG. 1, opposite from the front, is referred to as rear. A side, which corresponds to the viewer's upper-left side is referred to as a left-side face, and an opposite side from the left, which corresponds to the viewer's lower-right side, is referred to as a right-side face. The right-left direction of the image reading apparatus 1 may also be referred to as a crosswise direction. The up-down direction in FIG. 1 corresponds to a vertical direction of the image reading apparatus 1.

Detailed Configuration of the Image Reading Apparatus 1

As shown in FIGS. 1-5, the image reading apparatus 1 includes a chassis 8, a feeder tray 50, and a discharge tray 6.

Figure 5:
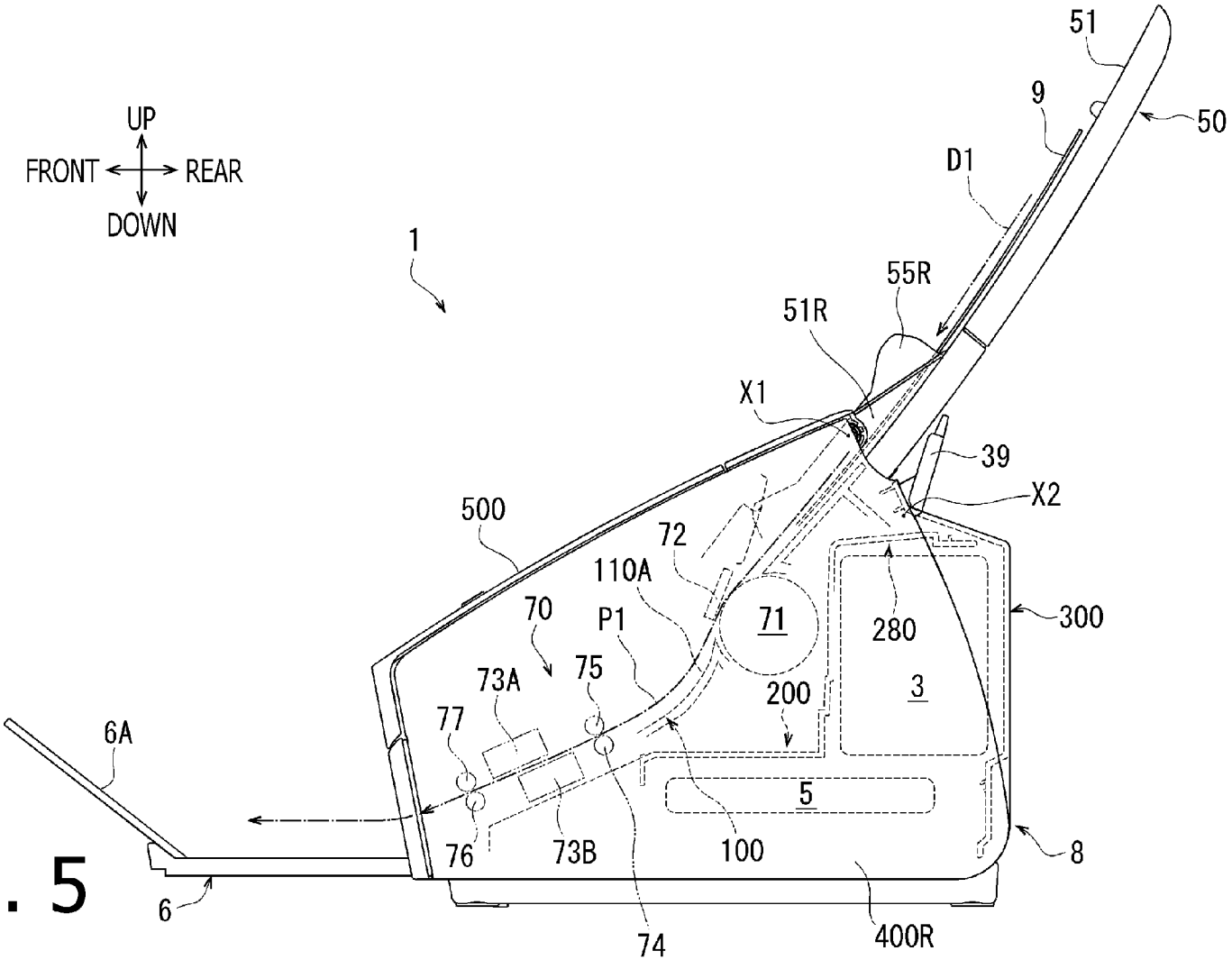
FIG. 5 is a side view of the image reading apparatus 1 according to the embodiment of the disclosure.
Figure 6:
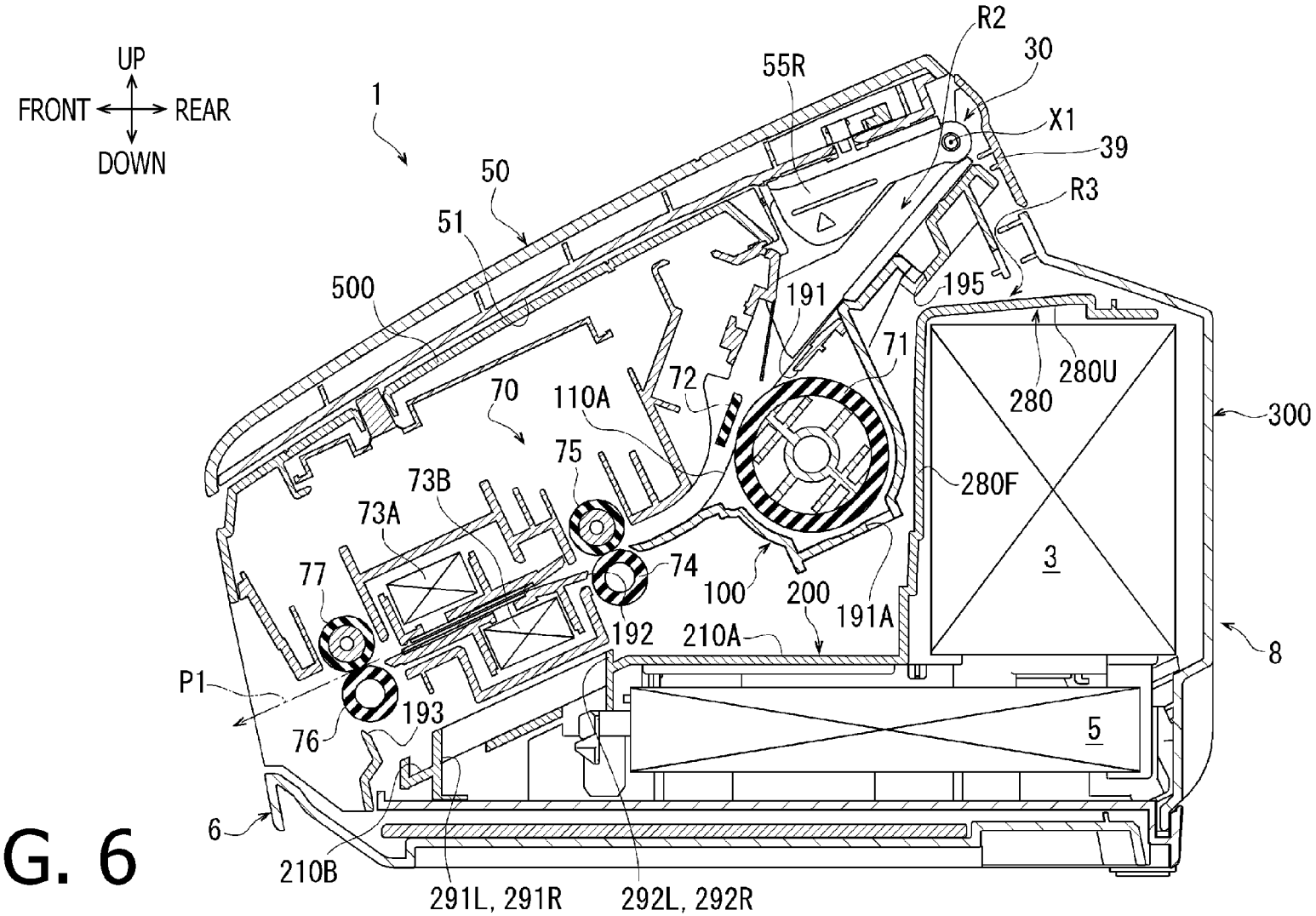
FIG. 6 is a cross-sectional side view of the image reading apparatus 1 according to the embodiment of the disclosure.

Further, as shown in FIGS. 5 and 6, the image reading apparatus 1 includes a power unit 3, a reader unit 70, and a control board 5.

Figure 2:
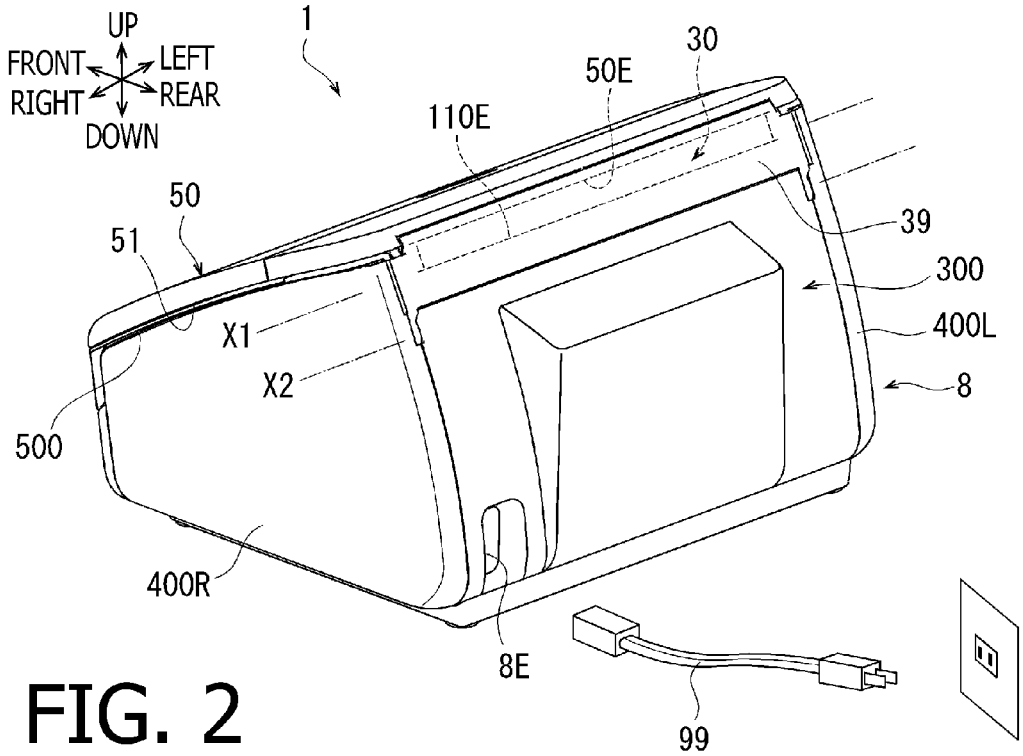
FIG. 2 is a perspective view of the image reading apparatus 1 showing a rear face according to the embodiment of the disclosure with a feeder tray 50 in a housed position.
Figure 3:
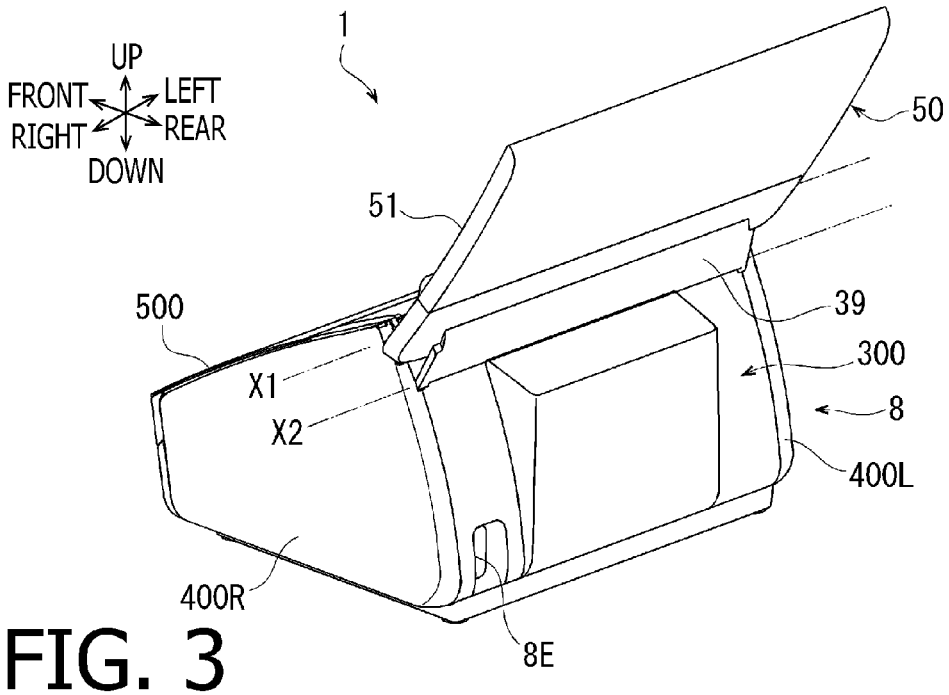
FIG. 3 is a perspective view of the image reading apparatus 1 showing the rear face according to the embodiment of the disclosure with the feeder tray 50 in usable position.
Figure 4:
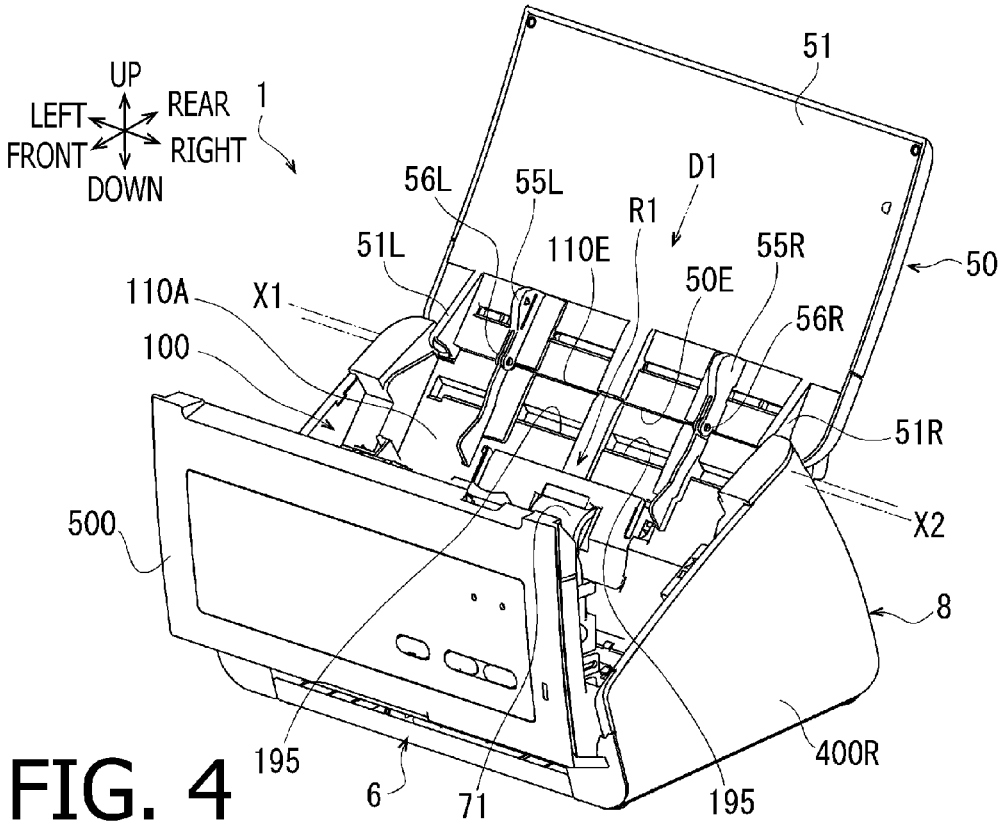
FIG. 4 is a perspective view of the image reading apparatus 1 showing the front face according to the embodiment of the disclosure with the feeder tray 50 in an open position.

The chassis 8 being a body of the image reading apparatus 1 includes, as shown in FIGS. 1-5, an upper cover 500 forming an upper face of the chassis 8, a rear cover 300 forming a rear face of the chassis 8, and lateral covers 400R, 400L, forming lateral (right and left) faces of the chassis 8. Further, as shown in FIGS. 4-6, the chassis 8 includes a lower chute 100 and a board cover 200, which are enclosed by the upper cover 500, the rear cover 300, and the lateral covers 400R, 400L.

Figure 1:
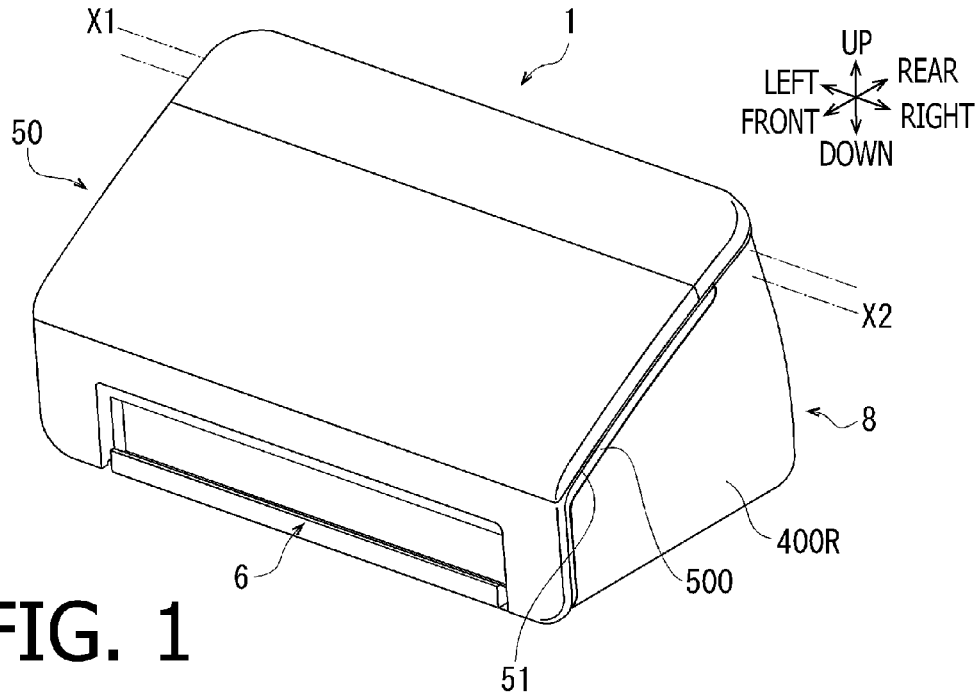
FIG. 1 is a perspective view an image reading apparatus 1 showing a front face according to an embodiment of the disclosure.

As shown in FIGS. 1 and 6, the upper cover 500 is formed in a shape of a plane panel, which is arranged to incline upward from the front face toward the rear face of the chassis 8 over the lower chute 100. However, the upper cover 500 is swingable to uplift a rear end thereof upward (see FIG. 4) when, for example, a user needs to access a bottom plane 110A of the lower chute 100 in order to handle a sheet jam or other maintenance operations. Detailed configuration of the lower chute 100 will be described later.

As shown in FIG. 4, the feeder tray 50 is formed in a thin plate, one side of which is configured to serve as a placement surface 51. On right-side and left-side corners of the feeder tray 50, hinges 51R, 51L are integrally formed. The feeder tray 50 is swingably supported by the chassis 8 to swing about a first swing axis S1, which extends in a crosswise direction at an upper rear position in the chassis 8, via the hinges 51R, 51L.

As shown in FIGS. 1 and 6, when in a closed posture, the feeder tray 50 is placed over the upper cover 500 with the placement surface 51 facing downward. The position of the feeder tray 50 in the closed posture shown in FIGS. 1 and 6 will be referred to as "housed position."

When being opened, as shown in FIGS. 3-5, the feeder tray 50 is moved to a rearward position with respect to the chassis 8 and into an open posture, in which the placement surface 51 faces upward. The position of the feeder tray 50 in the open posture as shown in FIG. 5 will be referred to as "usable position." When the feeder tray 50 is in the usable position, a sheet 9 can be placed on the placement surface 51 and can be conveyed from the placement surface 51 frontward in a descending inclination along a conveying direction D1 (see FIG. 5). In this regard, the direction of width of the sheet 9 ("sheet-width") being conveyed along a conveying direction D1 coincides with the crosswise (right-left) direction of the image reading apparatus 1. Meanwhile, the swing axis X1 extends in parallel with the direction of sheet-width and the crosswise direction. According to the embodiment, the term "parallel" may mean "substantially parallel", and terms "orthogonal" and "horizontal" which may be referred to later, may mean "substantially orthogonal" and "substantially horizontal" respectively.

FIGS. 7 and 8 illustrate perspective views of the chassis 8, in different angles, with the lower chute 100, the board cover 200, and the rear cover 300 assembled together, and with the feeder tray 50, the discharge tray 6, the upper cover 500, and the lateral covers 400R, 400L being removed therefrom. Each of the lower chute 100, the board cover 200, and the rear cover 300 is an integrally-formed resin piece, and the three pieces are assembled together in an arrangement illustrated in FIG. 9.

The lower chute 100 includes a main chute part 110 and a pair of lateral chute parts 120R, 120L (FIGS. 7-9).

As shown in FIGS. 6 and 7, the main chute part 110 of the lower chute 100 is formed to have a shape of a flat panel, which spreads in parallel with the crosswise direction and the first swing axis X1, and is arranged in an angled posture to decline from a position in the vicinity of the first swing axis X1 on the rear side toward the discharge tray 6 on the front side. In the present embodiment, the shape of "flat panel" may mean a shape of "substantially flat" and may include, for example, curved or bent forms. Further, the "flat panel" may include convexes and concaves thereon.

As shown in FIG. 10, the lateral chute parts 120R, 120L are formed integrally with the main chute part 110 and are arranged to face each other and to have the main chute part 110 placed in a midst position between the lateral chute parts 120R, 120L. Further, as shown in FIG. 9, the lateral chute parts 120R, 120L are formed to extend along the front-rear direction at the right and left ends of the main chute part 110 and to extend upward and downward with respect to the main chute part 110. The lateral chute parts 120R, 120L, together with the main chute part 110, serve as a part of a frame of the chassis 8.

As shown in FIGS. 6 and 7, an upper plane of the main chute part 110 spreads in the crosswise direction and is angled to decline from the position in the vicinity of the first swing axis X1 toward the discharge tray 6 on the front side. The upper plane of the main chute part 110 support a lower side of the sheet 9 being conveyed from below and serves as a bottom plane 110A of a conveyer path P1.

As shown in FIG. 4, when the feeder tray 50 is in the usable position, the bottom plane 110A provides a plane surface in continuity with the placement surface 51. When the feeder tray 50 is thus placed in the usable position, an edge 50E of the feeder tray 50 on a side of the first swing axis X1 is moved to be adjacent to an edge 110E of the main chute part 110 of the lower chute 100 on a side of the first swing axis X1 and stops thereat. In this state, as shown in FIG. 5, the sheet 9 may be placed on the placement plane 51. The sheet 9 placed on the placement plane 51 is conveyed over the placement surface 51 along the conveying direction D1, and a front end of the sheet 9 may reach the bottom plane 110A. In FIG. 9, inclination of the bottom plane 110A viewed along the crosswise direction is indicated by an auxiliary double-dotted chain line H1.

The board cover 200A includes, as shown in FIGS. 11 and 12, an upper cover part 210 and a pair of lateral cover parts 220.

The upper cover part 210 includes a horizontal section 210A, a front inclined section 210B, a right inclined section 210R, and a left inclined section 210L. The horizontal section 210A is formed in a central position within the upper cover part 210 and extends horizontally. The front inclined section 210B is formed to incline downward from a front edge of the horizontal section 210A toward the front with respect to a horizontal plane. The right inclined section 210R and the left inclined section 210L are formed at lateral ends of the horizontal section 210A and incline toward the same direction at the same angle as the inclination of the front inclined section 210B.

In FIG. 9, the inclination of the front inclined section 120B, the right inclined section 210R, and the left inclined section 210L is indicated by an auxiliary double-dotted chain line H2. As can be seen from the auxiliary lines H1, H2, the front inclined section 210B, the right inclined section 210R, and the left inclined section 210L of the upper cover part 210 are inclined at the same inclination angle in the same direction as the inclination of the bottom plane 110A. In the present embodiment, inclination "in the same direction" may mean inclination "in substantially the same direction" and may not necessarily mean being "in parallel."

As shown in FIG. 11, the board cover 200 is formed to have a power unit cover 280 integrally at a rear side of the horizontal section 210A. The power unit cover 280 includes a front face 280F and lateral faces 280R, 280L, which erect upward from the horizontal section 210A, and an upper face 280U, which is formed continuously with upper ends of the front face 280F and the lateral faces 280R, 280L. As shown in FIG. 6, the upper face 280U slightly inclines to descend toward the front side.

The lateral cover parts 220R, 220L are formed integrally with the upper cover part 210 and arranged to face each other to have the upper cover part 210 placed in a midst position between the lateral cover parts 220R, 220L. Further, as shown in FIG. 9, the lateral cover parts 220R, 220L are formed to extend along the front-rear direction at the right and left ends of the upper cover part 210 and to protrude downward with respect to the upper cover part 210. The lateral cover parts 220R, 220L, together with the upper cover part 210, serve as a part of the frame of the chassis 8.

As shown in FIGS. 2 and 9, the rear cover 300 is formed in a shape of a plane panel, which spreads in the crosswise and vertical directions. The rear cover 300 is inclined to descend toward the rear side. In FIG. 9, inclination of the rear cover 300 viewed along the crosswise direction is indicated by an auxiliary double-dotted chain line H3.

As shown in FIG. 10, the lower chute 100 is formed to have two tapped blind holes 141A, which protrude downward and are open downward, in vicinities of a front edge on a lower side thereof. Further, two tapped blind holes 141B, which protrude downward and are open downward, are formed in vicinities of a rear edge on the lower side of the lower chute 100. Furthermore, as shown in FIG. 9, the lateral chute parts 120R, 120L are perforated in the crosswise direction to have round holes 142 in rear end positions through thickness of the lateral chute parts 120R, 120L respectively (solely one on the lateral chute part 120R is shown in FIG. 9).

As shown in FIG. 12, in the front inclined section 210B in the board cover 200, two round through-holes 241A bored through the front inclined section 210B are formed. In each of the right and left inclined sections 210R, 210L, a round through-hole 241B bored through the right and left inclined sections 210R, 210L is formed. Further, as shown in FIGS. 9 and 11, on rear edges of the lateral cover parts 220R, 220L, screw holes 243 being recessed inward in the crosswise direction are formed.

As shown in FIG. 9, in the rear cover 300, a pair of enhancing ribs 301 protruding frontward and extending vertically are formed on right and left side edges of an inner surface of the rear cover 300 (solely one on the right edge is shown in FIG. 9). On an upper end of each enhancing rib 301, a screw hole 342 being recessed in the crosswise direction is formed. Further, on a lower side of each enhancing rib 301, a through hole 343 is formed to penetrate thickness of enhancing rib 301 in the crosswise direction.

As shown in FIGS. 8 and 9, the lower chute 100 and the board cover 200 are stably coupled to each other at four points by first screws 41 screwed upwardly from the bottom side of the board cover 200 into the tapped blind holes 141A, 141B through the through-holes 241A, 241B.

Further, as shown in FIGS. 7 and 9, the rear cover 300 is stably coupled to the lower chute 100 and to the board cover 200 at four points in the following manner. That is, second screws 42 are screwed laterally from outside toward inside into the screw holes 342 in the rear cover 300 through the through-holes 142 in the lateral chute parts 120R, 120L respectively. Further, third screws 43 are screwed into the screw holes 243 in the lateral cover parts 220R, 220L through the through-holes 343 in the rear cover 300. Accordingly, the rear cover 300 is stably coupled to the lower chute 100 and to the board cover 200 at the four points.

As shown in FIG. 6, the power unit 3 is disposed inside the chassis 8 in a position lower than the first swing axis X1 and a lower position with respect to the bottom plane 110A. The power unit 3 is an alternate current adaptor, which converts alternate current from an electricity outlet into direct current and supply the electricity to the reader unit 70. As shown in FIG. 2, on the rear side of the chassis 8, a connector hole 8E is formed. In the connector hole 8E, an end of an electricity cable 99 to electrically connect the power unit 3 with the electricity outlet is inserted.

As shown in FIG. 6, the control board 5 is arranged in a lower position with respect to the power unit 3 in the chassis 8. The control board 5 is a flat panel, which spreads along the crosswise and front-rear directions. The control board 5 is electrically connected with the power unit 3 and the reader unit 70 by cables (not shown) to control behaviors of the reader unit 70.

As shown in FIGS. 6 and 12, in a position between the control board 5 and the main chute part 110, the horizontal section 210A and the front inclined section 120B of the upper cover part 210 are arranged to spread in the front-rear and crosswise directions. Further, the lateral cover parts 220R, 220L are arranged in continuity with the upper cover part 210 with the control board 5 placed in the midst position between the lateral cover parts 220R, 220L. Thus, the control board 5 is covered from the upper, front, left, and right sides by the board cover 200.

As shown in FIG. 12, when the board cover 200 is viewed down from an upper position, in the front inclined section 210B, which is in the displaced position from the control board 5, rectangular shaped through-holes 291R, 291L are formed. Further, as shown in FIGS. 6 and 12, on the front inclined section 210B, upright partitions 292R, 292R surrounding edges of the through-holes 291R, 291L, are formed. Through the through-holes 291R, 291L, for example, cables to connect the control board 5 with the reader unit 70 may be arranged to penetrate the front inclined section 210B.

As shown in FIGS. 6 and 12, the upper face 280U of the power unit cover 280 is located in the position between the power unit 3 and the main chute part 110. On the front side and the lateral sides of the power unit 3, the front face 280F and the lateral faces 280R, 280L are located. Thus, the power unit 3 is covered from the upper, front, left, and right sides by the power unit cover 280. Further, as shown in FIG. 6, the rear sides of the control board 5 and the power unit 3 are covered by the rear cover 300.

As shown in FIGS. 5 and 6, the reader unit 70 is attached at least to the lower chute 100 in the chassis 8. The reader unit 70 includes a feed roller 71, a separator pad 72, an image reading sensors 73A, 73B, a first conveyer roller 74, a driven roller 75, a second conveyer roller 76, a driven roller 77, and an overfeed sensor (not shown). The feed roller 71, the first conveyer roller 74, and the second conveyer roller 76 convey the sheet 9 through the chassis 8 along the conveyer path P1.

As shown in FIG. 10, the main chute part 110 includes openings 191, 192, 193, which are formed through the main chute part 110.

As shown in FIGS. 6 and 7, the feed roller 71 is exposed partially at a circumference thereof from below to the conveyer path P1 through the opening 191. As shown in FIGS. 6 and 10, in a lower position with respect to the opening 191, on a bottom of the section in which the feed roller 71 is accommodated in the main chute part 10, a smaller opening 191A is formed. The opening 191A may be used, for example, to be engaged with parts which are attached to the lower chute 100. An upper area and a lower area with respect to the bottom plane 110A are in communication with each other through clearance between the opening 191 and the feed roller 71 and through the opening 191A.

The second conveyer roller 76 is exposed partially at a circumference thereof from the lower area lower than the bottom plane 110A to the conveyer path P1 through the opening 193. The upper area and the lower area with respect to the bottom plane 110A are in communication with each other through clearance between the opening 193 and the second conveyer roller 76.

As shown in FIG. 6, the driven roller 75 is arranged in an upper position with respect to the first conveyer roller 74 across the conveyer path P1 and is urged against the first conveyer roller 74. The driven roller 77 is arranged in an upper position with respect to the second conveyer roller 76 across the conveyer path P1 and is urged against the second conveyer roller 76.

The overfeed sensor, which is not shown, exposes a detector surface thereof to the conveyer path P1 from the lower area lower than the bottom plane 110A through an opening (not shown). The upper area and the lower area with respect to the bottom plane 110A are in communication with each other through clearance between the opening and the overfeed sensor.

As shown in FIG. 5, in the reader unit 70, the feed roller 71, the separator pad 72, the first conveyer roller 74, the driven roller 75, the second conveyer roller 76, and the driven roller 77 are manipulated to separate the sheet 9 from the other sheets placed on the placement surface 51 and convey the separated sheet 9 in the conveyer path P1. The bottom plane 110A supports the sheet 9 being conveyed from below. The bottom plane 110A spreads in the direction of width of the sheet 9 and extends from an upstream end to a downstream end along the sheet conveying direction D1. The overfeed sensor detects whether the sheet 9 being conveyed includes two or more sheets.

As the sheet 9 is conveyed along the conveyer path P1, the reader unit 70 executes a reading operation with the sheet 9. More specifically, the reader unit 70 reads images appearing on both sides of the sheet 9 by the image reader sensors 73A, 73B. The image reader sensors 73A, 73B may be, for example, contact image sensors (CIS) or charge coupled devices (CCD). The behaviors of the reader unit 70 are controlled by the control board 5.

As shown in FIGS. 1 and 5, the discharge tray 6 can be stored in or drawn out of the chassis 8. When the discharge tray 6 is stored in the chassis 8 (see FIG. 1), the discharge tray 6 is exposed only at a front end of the discharge tray 6. When the discharge tray 6 is drawn out of the chassis 8 (see FIG. 5), the discharge tray 6 can be placed in a posture to have a discharge surface 6A facing upward in a frontward position with respect to the chassis 8.

As the images are read from the sheet 9 by the reader unit 70, and the sheet 9 is further conveyed along the conveyer path P1 under control of the control board 5, the sheet 9 is discharged in the discharge tray 6 on the discharge surface 6A. When a plurality of sheets 9 are placed on the placement surface 51, the sheets 9 are separately conveyed one-by-one along the conveyer path P1 to have images read by the reader unit 70 and stacked on the discharge surface 6A sequentially.

As shown in FIGS. 2, 6, and 7, when the feeder tray 50 is moved from the usable position and placed in the housed position, an edge 110E of the main chute part 110 on the side closer to the first swing axis X1, amongst edges of the main chute part 110 extending in parallel with the swing axis X1, and an edge 50E of the feeder tray 50 on the side closer to the first swing axis X1, amongst edges of the feeder tray 50 extending in parallel with the first swing axis X1, are spaced apart vertically from each other and form an opening 30.

As shown in FIGS. 2 and 3, the image reading apparatus 1 has an opening cover 39, which covers the opening 30 when the feeder tray 50 is in the housed position. The opening cover 39 is swingable about a second swing axis X2, which extends in parallel with the first swing axis X1 in a lower position with respect to the first swing axis X1.

As shown in FIGS. 2 and 6, the opening cover 39 covers the opening 30 when the feeder tray 50 is in the housed position. The opening cover 39 moves along with the feeder tray 50, as the feeder tray 50 swings to the usable position, to retract in a lower position with respect to the feeder tray (see FIGS. 3 and 6).

As shown in FIG. 4, the image reading apparatus 1 further includes a pair of rib-shaped width-position guides 55R, 55L, which are arranged in line-symmetrical crosswise (right and left) positions with each other. The width-position guides 55R, 55L serve to place the sheet 9 in a correct crosswise position on the placement surface 51. The width-position guides 55R, 55L extend in parallel with the conveying direction D1 from an upper end of the placement surface 51 to the bottom plane 110A. Each of the width-position guides 55R, 55L is formed to have a joint 56R, 56L in a longitudinally midst position along the conveying direction D1. As shown in FIGS. 6 and 7, the joints 56R, 56L allow the width-position guides 55R, 55L to be folded or to align straight by rotating about the first swing axis X1 when the feeder tray 50 is moved from the housed position to the usable position, and vice versa.

As shown in FIG. 10, the main chute part 110 has an opening 195, which is formed in a position in the vicinity of the edge 110E of the main chute part 110 on the side closer to the first swing axis X1. The opening 195 formed as a narrow guide rail extends in the crosswise direction and vertically penetrates the thickness of the main chute part 110. The width-position guides 55R, 55L are slidable in the crosswise direction to be guided along the opening 195. The upper area and the lower area with respect to the bottom plane 110A are in communication with each other through clearance between edges of the opening 195 and the width-position guides 55R, 55L.

As the width-position guides 55R, 55L move toward or to be away from each other to the correct crosswise position for the sheet 9 on the bottom plane 110A, the images on the sheet 9 can be read correctly in the image reading apparatus 1 whilst the size of the sheet 9 may vary between, for example, a business-card size and a letter size.

Effects of the Present Disclosure

When liquid (e.g., water) is spilled over the image reading apparatus 1, and when the feeder tray 50 is in the usable position, the water may flow along a pathway R1 (see FIG. 4) on the placement surface 51 and wet the bottom plane 110A. For another example, when the feeder tray 50 is in the housed position, the water may flow inside the chassis 8 along a pathway 2 (see FIG. 6) through the clearance 30 between the feeder tray 50 and the opening cover 39 and wet the bottom plane 110A. In such cases, the water may flow into the lower area with respect to the bottom plane 110A through any of the clearances between the opening 191 and the feed roller 71, between the opening 192 and the first conveyer roller 74, between the opening 193 and the second conveyer roller 76, between the opening (not shown) and the overfeed sensor (not shown), and between the opening 195 and the width-position guides 55R, 55L. However, according to the above-described configuration, with the horizontal section 210A, the front inclined section 210B, and the right and left inclined section 210R, 210L of the board cover 200 arranged in between the bottom plane 110A and the control board 5, the flow of the liquid is blocked. Therefore, the water entering the chassis 8 can be prevented from accessing the control board 5. Thus, the image reading apparatus 1 according to the embodiment can prevent the control board 5 from being damaged by the liquid.

Further, in the image reading apparatus 1 according to the present embodiment, the bottom plane 110A is arranged to incline downward from the upstream end toward the downstream end of the conveying direction D1. Therefore, a size of the image reading apparatus 1 may be reduced compared to an image reading apparatus, of which bottom plane 110A is arranged horizontally.

Further, in the image reading apparatus 1 according to the present embodiment, the board cover 200 includes the upper cover part 210, which covers at least the upper part of the control board 5, and the lateral cover parts 220R, 220L, which are formed integrally with the upper cover part 210 having the upper cover part 210 in the midst position there-between. In this structure, the chassis 8 can be enhanced, and rigidity of the chassis 8 can be improved.

Further, in the image reading apparatus 1 according to the present embodiment, as can be seen in the auxiliary lines H1, H2 (see FIG. 9), the inclination angle of a part of the bottom plane 110A is the same as the inclination angle of the upper cover part 210. In other words, the bottom plane 110A and the upper cover part 210 are arranged to incline at the same angle and in vertically stacked arrangement. Therefore, the rigidity of the chassis 8 can be improved even more.

Further, in the image reading apparatus 1 according to the present embodiment, the power unit cover 280 is arranged in between the bottom plane 110A and the power unit 3 in the chassis 8. The power unit cover 280 covers the upper side, the front side, and the right and left sides of the power unit 3 with the upper face 280U, front face 280F, and the lateral faces 280R, 280L. Therefore, for example, when the feeder tray 50 is in the housed position, and when liquid flows into the chassis 8 through the clearance between the opening cover 39 and the rear cover 300 along the pathway R3 (see FIG. 6), the liquid is blocked by the power unit cover 280 and is prevented from accessing the power unit 3. Furthermore, with the power unit cover 280 being integral with the board cover 200, a quantity of parts in the image reading apparatus 1 may be reduced.

Further, in the image reading apparatus 1 according to the present embodiment, the lower chute 100 and the board cover 200 are coupled to each other by the first screws 41 screwed upward to the tapped blind holes 141A, 141B, which are formed to open downward, through the through-holes 241A, 241B formed in the board cover 200. Therefore, the screws or the screw holes are prevented from being exposed to the conveyer path P1 above the lower chute 100, and the sheet 9 being conveyed can be prevented from being interfered with by the screws or the screw holes. Furthermore, the liquid entering the chassis 8 may be prevented from being flowing through the screwed areas surrounding the first screws 41 (i.e., the tapped blind holes 141A, 141B and the through-holes 241A, 241B).

Further, in the image reading apparatus 1 according to the present embodiment, the rear cover 300 coupled to the lower chute 100 and the board cover 200 provides the rear face of the chassis 8. Therefore, as can be seen in the auxiliary lines H1, H2, H3 (see FIG. 9), the lower chute 100, the board cover 200, and the rear cover 300 assembled together form a channel geometry or a shape of triangle, when viewed along the crosswise direction. Accordingly, the rigidity of the chassis 8 can be even more improved.

Further, in the image reading apparatus 1 according to the present embodiment, the board cover 200, the lower chute 100, and the rear cover 300 are made of plastic resin. Therefore, the board cover 200 can be formed in the shape to cover the control board 5 easily. In other words, the board cover 200 can be less restricted in design for its shape compared to, for example, metal. If the board cover 200 is made of metal, it would be difficult to form some parts, such as the partitions 292R, 292L, to block fluid. Further, if the board cover 200 is made of metal, it would be difficult to form the board cover 200 to have a structure to direct the liquid in a specific direction, such as the front inclined section 210B. However, according to the present embodiment, with the board cover 200 made of resin, the board cover 200 can be less restricted in design for its shape and is allowed to have the above-mentioned difficult structures. Therefore, the liquid can be securely prevented from accessing the control board 5. Similarly, the lower chute 100 can be also less restricted in its design and can be formed in the shape, which allows the sheet 9 to be conveyed effectively. Furthermore, the rear cover 300 can be also less restricted in its design; therefore, an external appearance of the image reading apparatus 1 may be improved. Moreover, due to the shape of channel geometry or the shape of triangle formed by the lower chute 100, the board cover 200, and the rear cover 300 assembled together, when viewed along the crosswise direction, the rigidity of the chassis 8 can be improved even without a metal structure to enhance the rigidity. Thus, weight and manufacturing cost of the image reading apparatus 1 may be effectively reduced.

Further, in the image reading apparatus 1 according to the present embodiment, the rear cover 300 and the lower chute 100 are coupled to each other by the second screws 42 screwed in the crosswise direction, and the rear cover 300 and the board cover 200 are coupled to each other by the third screws 43 screwed in the crosswise direction. In these arrangements, the screwed areas (i.e., the second screws 42 and the third screws 43) can be covered by the lateral covers 400R, 400L to improve the external appearance of the image reading apparatus 1.

Further, in the image reading apparatus 1 according to the present embodiment, as shown in FIG. 12, when the board cover 200 is viewed down from an upper position, the through-holes 291R, 291L are formed in the front inclined section 210B, which is in the vertically displaced position from the control board 5, on the board cover 200. Further, as shown in FIGS. 6 and 12, the upright partitions 292R, 292L surrounding edges of the through-holes 291R, 291L, are formed on the front inclined section 210B. With this structure, the control board 5 can be securely prevented from being reached by the liquid, and the cables to be connected to the control board 5 can be arranged easily and effectively without detouring.

Further, in the image reading apparatus 1 according to the present embodiment, the lower chute 100 includes the main chute part 110, of which upper surface serves as the bottom plane 110A for the conveyer path P1, and the pair of lateral chute parts 120R, 120L, which have the main chute part 110 in the midst position there-between. In this configuration, the chassis 8 can be enhanced, and the rigidity of the chassis 8 can be improved.

Although an example of carrying out the disclosure have been described, those skilled in the art will appreciate that there are numerous variations and permutations of the sheet conveyer device that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the lower chute 100 may be arranged to have the bottom plane 110A to extend horizontally. Additionally or alternatively, the main chute part 110 may be formed separately from the lateral chute parts 120R, 120L.

For another example, upper cover part 210 in the board cover 200 may be formed separately from the lateral cover parts 220R, 220L. Additionally or alternatively, the board cover 200 may be formed separately from the power unit cover 280.

The sheet conveyer device according to the present disclosure may be applied to, for example, an image reading apparatus, an image forming apparatus or a multifunction device.

What is claimed is:

1. A sheet conveyer, comprising:

a body, in which a conveyer path is formed, wherein the sheet conveyer is configured to convey a sheet along the conveyer path, and a lower chute comprising a conveyer plane configured to support a lower side of the sheet being conveyed from below, wherein an opening is formed in the conveyer plane, wherein the conveyer path and a lower area with respect to the lower chute are connected with each other through the opening;

a processing unit arranged in the body and configured to execute a process with the sheet being conveyed in the conveyer path;

a conveyer roller partially exposed from the conveyer plane to the conveyer path through the opening and configured to convey the sheet in a conveying direction;

a control board arranged inside the body in the lower area with respect to the conveyer plane and configured to control the processing unit to execute the process;

a board cover arranged inside the body in a position between the conveyer plane and the control board and configured to cover at least an upper part of the control board;

a power unit arranged inside the body in a lower position with respect to the conveyer plane and configured to supply electricity to the processing unit; and a power unit cover arranged inside the body in a position between the conveyer plane and the power unit, formed integrally with the board cover, and configured to cover at least an upper part of the power unit.

2. The sheet conveyer according to claim 1, wherein the conveyer plane is inclined to descend from the upstream end toward the downstream end in the sheet conveying direction.

3. The sheet conveyer according to claim 1, wherein the board cover comprises an upper cover part configured to cover the upper part of the control board and a pair of facing parts formed integrally with the upper cover part and arranged to face each other, wherein the upper cover part is disposed between the facing parts.

4. The sheet conveyer according to claim 3, wherein the conveyer plane is inclined to descend from the upstream end toward the downstream end in the sheet conveying direction.

5. The sheet conveyer according to claim 4, wherein the upper cover part is inclined in a same direction as a direction of inclination of the conveyer plane.

6. The sheet conveyer according to claim 1, further comprising:

a first screw configured to be screwed from below in a tapped blind hole formed to open downwardly in the lower chute through the board cover and configured to couple the lower chute and the control board to each other.

7. The sheet conveyer according to claim 1, wherein the board cover is made of resin.

8. The sheet conveyer according to claim 1, further comprising:

a rear cover configured to spread in a direction of width of the sheet and to be coupled to the lower chute and to the board cover to form a rear face of the sheet conveyer device.

9. The sheet conveyer according to claim 8, wherein the board cover is made of resin.

10. The sheet conveyer according to claim 9, wherein the lower chute and the rear cover are made of resin.

11. The sheet conveyer according to claim 8, further comprising:

a second screw configured to couple the rear cover and the lower chute to each other and a third screw configured to couple the rear cover and the board cover to each other, the second screw and the third screw being screwed in the direction of width.

12. The sheet conveyer according to claim 1, wherein the board cover comprises a through-hole in a position vertically displaced from the control board.

13. The sheet conveyer according to claim 12, wherein the board cover comprises an upright partition surrounding an edge of the through-hole.

14. The sheet conveyer device according to claim 1, wherein the lower chute comprises a pair of facing parts arranged to face each other, and wherein the conveyer plane is disposed between the facing parts.

15. A sheet conveyer, comprising:

a body, in which a conveyer path is formed, wherein the sheet conveyer is configured to convey a sheet along the conveyer path, and a lower chute comprising a conveyer plane configured to support a lower side of the sheet being conveyed from below, wherein an opening is formed in the conveyer plane, wherein the conveyer path and a lower area with respect to the lower chute are connected with each other through the opening;

a processing unit arranged in the body and configured to execute a process with the sheet being conveyed in the conveyer path;

a conveyer roller partially exposed from the conveyer plane to the conveyer path through the opening and configured to convey the sheet in a conveying direction;

a control board arranged inside the body in the lower area with respect to the conveyer plane and configured to control the processing unit to execute the process;

a board cover arranged inside the body in a position between the conveyer plane and the control board and configured to cover at least an upper part of the control board; and a first screw configured to be screwed from below in a tapped blind hole formed to open downwardly in the lower chute through the board cover and configured to couple the lower chute and the control board to each other.

16. A sheet conveyer, comprising:

a body, in which a conveyer path is formed, wherein the sheet conveyer is configured to convey a sheet along the conveyer path, and a lower chute comprising a conveyer plane configured to support a lower side of the sheet being conveyed from below, wherein an opening is formed in the conveyer plane, wherein the conveyer path and a lower area with respect to the lower chute are connected with each other through the opening;

a processing unit arranged in the body and configured to execute a process with the sheet being conveyed in the conveyer path;

a conveyer roller partially exposed from the conveyer plane to the conveyer path through the opening and configured to convey the sheet in a conveying direction;

a control board arranged inside the body in the lower area with respect to the conveyer plane and configured to control the processing unit to execute the process; and a board cover arranged inside the body in a position between the conveyer plane and the control board and configured to cover at least an upper part of the control board, wherein the board cover comprises a through-hole in a position vertically displaced from the control board.

* * * * *